US007070069B2

(12) United States Patent
Ho

(10) Patent No.: US 7,070,069 B2
(45) Date of Patent: Jul. 4, 2006

(54) AEROSOL SYSTEM HAVING LOCKABLE CAP

(75) Inventor: Yeong Ho, Cupertino, CA (US)

(73) Assignee: Connetics Corporation, Palo Alto, CA (US)

( * ) Notice: Subject to any disclaimer, the term of this patent is extended or adjusted under 35 U.S.C. 154(b) by 0 days.

(21) Appl. No.: 10/198,804

(22) Filed: Jul. 19, 2002

(65) Prior Publication Data

US 2003/0168473 A1 Sep. 11, 2003

Related U.S. Application Data

(60) Provisional application No. 60/363,009, filed on Mar. 7, 2002.

(51) Int. Cl.
*B67B 5/00* (2006.01)

(52) U.S. Cl. ..... 222/153.1; 222/153.09; 215/225; 220/915

(58) Field of Classification Search ..... 222/153.09, 222/153.1; 215/223–225, 206; 220/915
See application file for complete search history.

(56) References Cited

U.S. PATENT DOCUMENTS 3,747,807 A * 7/1973 Gach ..... 222/153.1
3,866,802 A * 2/1975 Birrell ..... 222/153.1
4,315,576 A 2/1982 Murphy et al.
4,328,911 A 5/1982 Knickerbocker
4,354,621 A 10/1982 Knickerbocker
5,316,162 A * 5/1994 Pierson ..... 215/223
D405,371 S 2/1999 Herr
5,957,337 A 9/1999 Bettison, Jr.
5,971,214 A 10/1999 Bettison, Jr.
D421,909 S 3/2000 Opresco
D427,528 S 7/2000 Krueger
6,196,423 B1 * 3/2001 Erxleben ..... 222/153.1
D460,360 S 7/2002 Diete
D462,269 S 9/2002 Hunter et al.
D465,410 S 11/2002 Kikuchi

* cited by examiner

*Primary Examiner*—Timothy L. Maust
(74) *Attorney, Agent, or Firm*—Townsend & Townsend & Crew LLP

(57) ABSTRACT

A dispense system such as an aerosol or pump system includes a container having an upper rim, a collar secured to the upper rim, and a cap removably attached to the collar. The collar may be rotatably secured to the container such that when the cap is rotated, the cap and collar rotate together about the rim of the container without detaching. The cap may enclose an actuator or pump of the container preventing inadvertent dispensing of the contents as well as rendering the container more tamper resistant. Each of the cap and collar includes various features to interlock with one another. In one variation, the cap includes at least one tooth which engages a slot or an opening in the collar to achieve locking. The cap may be rotated or snap fit into place depending on the variation. Caps that are directly mountable to a rim of a container are also disclosed.

44 Claims, 15 Drawing Sheets

AEROSOL SYSTEM HAVING LOCKABLE CAP

CROSS-REFERENCE TO RELATED APPLICATIONS

This application claims the benefit of U.S. Provisional Patent Application No. 60/363,009, filed Mar. 7, 2002, which is incorporated in its entirety by reference.

TECHNICAL FIELD

The present invention relates to dispense systems and in particular to aerosol systems which have lockable caps.

BACKGROUND

Aerosol containers hold and selectively dispense numerous types of materials for personal and household uses. Aerosol cans, for example, dispense topical foams, shaving cream, household cleaning fluids, spray paints, biologically active fluids, therapeutic fluids, and other materials. Aerosol containers may be made of various materials including steel, tin, aluminum, plastic and glass. When the container is made of glass, however, a protective coating is typically applied to the can's exterior to prevent the can from exploding when accidentally dropped. The protective coating may be, for example, plastic.

Aerosol containers normally comprise a generally cylindrical can and an upper or top section crimped or rolled onto the can. The top section typically includes a centrally disposed valve assembly having a slideable valve stem. A spout or push button, for example, may be secured to the valve stem and when the push button is depressed, the pressurized contents within the container emanate through the valve stem and out a nozzle.

Given the various applications for aerosol containers and their presence in many households, child resistant aerosol systems are desirable. It is particularly desirable to have an aerosol container that prevents a child from inadvertently emitting a toxic or otherwise harmful material from the aerosol container by merely depressing the aerosol push-button.

Various techniques to thwart a child's attempt to dispense aerosol substances from an aerosol canister are known. U.S. Pat. No. 4,315,576, for example, describes an overcap that is detachably fastened over a peripheral flange of a container. The cap includes a bottom flange having a plurality of fulcrum members. The cap may be detached upon applying a force by a user to cause the cap to pivot about the fulcrum members releasing the same from the container.

U.S. Pat. Nos. 5,957,337 and 5,971,214 disclose an aerosol spray apparatus that sprays in one or a limited number of directions. The direction of the spraying is in accordance with a feature on a spray head and a mating feature on a mounting cup. When the mating alignment is achieved spraying may occur.

U.S. Pat. Nos. 4,354,621 and 4,328,911 disclose another aerosol assembly including an actuator button connected through a valve stem to a valve assembly for releasing an aerosol product through the valve. The assembly further includes an overcap rotatably secured to the aerosol container and a finger actuator movably mounted relative to the overcap. The aerosol product is discharged upon a selected movement of the finger actuator relative to the actuator button.

None of the above described aerosol assemblies, however, provide the features and aspects of the present invention as hereinafter described.

SUMMARY OF THE INVENTION

Dispensing systems described herein comprise a container having an upper mounting lip, a collar secured to the upper mounting lip, and a cap removably attached to the collar. The collar may be either fixedly or rotatably secured to the container. The cap is adapted to releasably lock with the collar.

In one variation of the present invention, a dispensing system comprises a container having an upper rim and an actuator for selectively dispensing contents of the container. The actuator may be, for example, a push button or a spout. The dispensing system further includes a collar rotatably attached to the upper rim of the container. A cap is detachably locked to the collar, enclosing the actuator. The cap has at least one primary feature adapted to interlock with a complementary feature on the collar such that when the primary feature is interlocked with the complementary feature the cap is locked to the collar and when the cap is rotated the cap and collar rotate together preventing the cap from detaching from the container. In one variation the primary feature of the cap is a tooth and the complementary feature of the collar is an opening adapted to receive the tooth. In a variation, the cap includes a plurality of teeth and the collar includes a plurality of openings adapted to receive the teeth. The teeth (and corresponding openings) may be identical or different in shape and or size. The teeth may be disposed opposite to one another and the cap may be deformable such that the cap may be squeezed in order to insert the teeth into the openings. The teeth of the cap may be snap-fit into place.

Also, a tooth may extend from a deflectable tab which is biased to lock with the collar. To unlock the cap, the tab is depressed such that the tooth extending from the tab no longer penetrates an opening in the collar. Once the tooth no longer penetrates the opening, the cap may be manipulated off the collar.

The teeth may project inwardly or outwardly from the cap to interlock with corresponding openings. In particular, when a lower portion of the cap is configured to surround the collar, the teeth on the cap may project inwardly to interlock with corresponding openings in the collar. Also, when the lower portion of the cap is configured to fit within the collar, the teeth of the cap may project outwardly to interlock with the corresponding openings in the collar.

In another variation of the present invention, the cap includes a tooth and the collar includes a slot. The slot can include a stop such that when the cap is positioned on the collar and the cap is rotated relative to the collar into a locked position, the cap is prevented from further rotation by the stop. The collar may further include a rim which provides a surface for the tooth to follow into the slot. Also, the slot may include a protrusion to secure the tooth into the slot after the tooth passes across the protrusion.

The present invention includes various shaped containers. The upper rim or lip of the container may, for example, project inward or outward. Also, the container may be but is not limited to aluminum, steel, tin, plastic or a coated glass. A coating (e.g., plastic) may be disposed on the exterior of the container. The coating on the outside prevents a glass can from exploding when dropped. Additionally, an inner coating may be provided to prevent corrosion of the container due to the substance being held within the container. Inner coatings may be plastics or, for example, an epoxy. Another example of a material which may be used for the inner coating is polyamid-imid or PAM.

In another variation of the present invention, a dispense system includes a container, a collar attached to the upper lip of the container, and a cap. In this variation, the cap includes a locking means for releasably or removably attaching the cap to the collar. The locking means may include the above described constructs, the constructs described hereinafter, or any equivalents thereof.

It is also contemplated that cap assemblies may be provided without canisters. These cap assemblies may be incorporated into a dispense system as described herein or they may be used in a method of retrofitting a container having an actuator. The method comprises a.) mounting a rotatable collar to the container such that the collar may rotate about the container when twisted; and b.) detachably affixing a cap onto the collar such that when the cap is rotated the cap and collar rotate as a whole about the container without unscrewing. The cap encloses an actuator member located on the mounting cup of the container thereby preventing access to the actuator. The container in one variation is an aerosol can. Also, the step of detachably affixing a cap onto the collar may further include rotating the cap relative to the collar or squeezing the cap to position at least one tooth of the cap into an opening in the collar. The cap may be snap fit into a locked position.

In another variation of the present invention, the method further comprises removing a conventional cap from the container prior to rotatably mounting the collar to the container.

Another cap assembly described herein does not require a collar or other type of proxy member. The cap assembly may be directly mounted to the container. It includes a body and a locking member. The locking member is movable or pivotable relative to the body of the cap. When the cap is positioned on the can and the locking member is releasably locked to the upper rim of the can, the cap is not manually deformable and consequently cannot be removed from the can. When the locking member is unlocked from the upper rim of the can the cap is manually deformable and may be manipulated off the can to provide access to the actuator of the can.

Another cap comprises a body having an open lower portion configured to mount onto an upper rim of a can. The cap also includes a pivotal member having a fixed end, a free end, and a lip extending from the free end. The pivotal member is configured to rotate about the fixed end such that the lip may releasably lock with the upper rim of the can when the cap is positioned on the can. The pivotal member may further comprise an inwardly disposed tooth intermediate of the free end and the fixed end. Also, the cap may comprise a strut attached to at least one wall of the body of the cap. The strut may have a receiving portion adapted to releasably receive the tooth of the pivotal member. The receiving portion of the strut may be an opening, a groove, or a slot. In one configuration, the receiving portion is a slot.

The pivotal (or movable) member may comprise a number of additional features such as a lever means for releasing the pivotal member from a locked position. The movable member may also have button portion such that when the button portion is depressed, the movable member urges a lip on the free end to engage and lock onto the upper rim of the container. The movable member may also have more than one joint or more than two joints intermediate the fixed end and the movable end. The movable member may also conform to the shape of the cap when in its locked configuration.

The pivotal member may further comprise a distal section having a channel. The channel may be adapted to receive an axle of the cap such that the distal section of the pivotal member may pivot about the axle to lock and unlock the lip from the upper rim of the can.

Each of the caps described herein may be constructed as one integral part such as one integral injection molded plastic part. Or, the cap may be fabricated from a number of components and joined together.

Still other variations of the present invention will become apparent upon reading the following detailed description and appended claims with reference to the accompanying drawings.

DETAILED DESCRIPTION

The present invention relates to dispensing systems and in particular, to aerosol dispensing systems having a lockable cap assembly. For example, one dispensing system comprises a container having an upper mounting lip, a collar secured to the upper mounting lip, and a cap removably attached to the collar. The collar may be rotatably secured to the container and the cap is adapted to releasably lock with the collar. Consequently, an individual such as a child attempting to open the container may continuously rotate the entire cap assembly without unscrewing or detaching the cap from the container. Only upon manipulating the components of the cap assembly properly, as described below, may the cap be detached from the container.

It is to be understood that while it is intended that the aerosol systems and cap assemblies described herein hinder or prevent children from dispensing or gaining access to potentially harmful contents within the containers, nothing in this disclosure is a representation, warranty, or guarantee that the containers described herein meet any governmental regulatory requirements so as to be considered "child resistant." See, for example, child resistant requirements as set forth by the Consumer Product Safety Commission (CPSC).

Figure 1C:
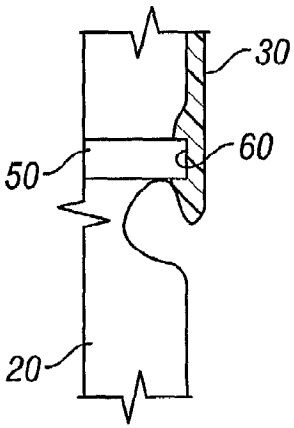
FIG. 1C is a partial cross sectional view of the aerosol system shown in FIG. 1A taken along line 1C—1C.
Figure 1B:
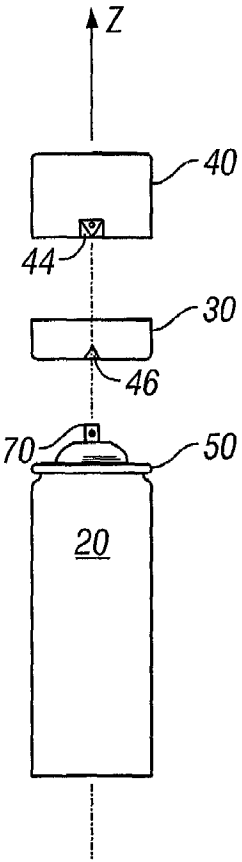
FIG. 1B is an exploded view of the aerosol system shown in FIG. 1A.
Figure 1A:
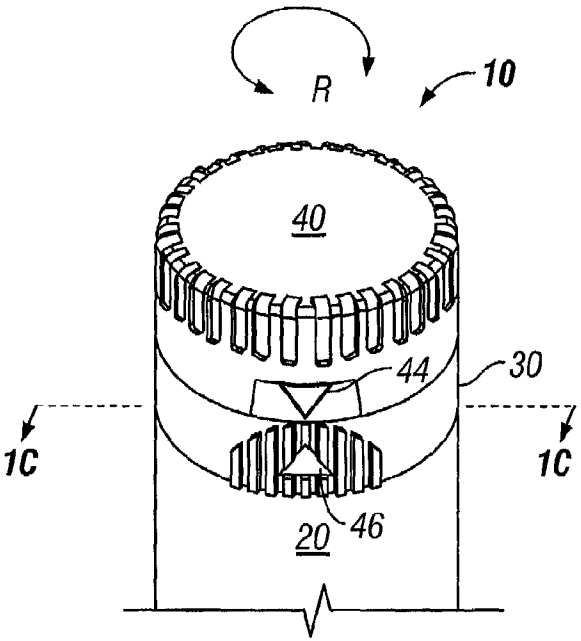
FIG. 1A is a partial perspective view of an aerosol system.

Turning now to FIG. 1A, a partial perspective view of an aerosol system (10) is depicted. The aerosol system (10) includes a container (20) and a cap assembly mounted onto the container. The cap assembly includes a collar (30) rotatably mounted to the container and a cap (40) removably attached to the collar. In particular, the collar (30) is rotatably mounted onto an upper mounting rim (50) or flange projecting outwardly from the container as shown in FIGS. 1B and 1C. The collar (30) shown in FIG. 1C includes an annular slot (60) adapted to receive the rim (50) of the container. Once the slot (60) is snap fit over the rim (50), the collar is prevented from moving axially (i.e., in the Z direction) but is free to rotate (R) about the rim.

The constructs for connecting the collar to the container can vary widely and still be in accordance with the present invention. For example, the collar may comprise an annular rim projecting inwardly and the container may comprise an annular slot for receiving the rim. Also, the container may comprise an inwardly projecting rim and the collar may comprise an annular slot on the outer surface of the collar. Also, the slots or the rims need not be continuous and may be discrete sections or portions. Also, the collar may comprise discrete upper and lower stops to prevent axial movement relative to the container. Of course, other features may be used to rotatably mount the collar to the container allowing rotation (R) about the mounting lip yet prohibiting movement in the axial direction (Z). In one variation, clearance between the features provides free rotation but prevents the collar from unscrewing or detaching from the container.

Referring to FIG. 1A, the cap (40) is shown locked onto the collar (30). The cap (40) is positioned and manipulated on the collar (30) until indicia (44, 46) are aligned. When the indicia are aligned, the cap is properly locked to collar (30). Consequently, the dispense actuator such as push button (70) shown in FIG. 1B is inaccessible when the cap is properly locked.

Various modifications may be made to the aerosol system (10) shown in FIGS. 1A–1C. For example, other actuating mechanisms and nozzles may be used in the aerosol system of the present invention. Examples of nozzles include but are not limited to elongated and comb-shaped spouts or nozzles. These serve to organize ejection of the contents of the can onto a target area. Also, the contents of the can may be pressurized or unpressurized. When the contents are unpressurized, the actuator may be, for example, a pump device.

Additionally, the indicia used to facilitate locking and unlocking of the cap assembly may be omitted. That is, locking and unlocking may be performed without reference to indicia. In one variation, the indicia may be configured such that when aligned, the components of the cap assembly may be unlocked and separated.

Exemplary materials for the cap and the collar are polymers and copolymer materials such as polypropylene and polyethylene. Also, the components of the system may be made of other materials. Also, the cap and collar may be fabricated using various techniques including, for example, machining, casting, extrusion molding and injection molding. The collar and cap are sized and dimensioned for being affixed to a container and in particular an aerosol container adapted to hold and dispense pressurized fluids. A conventional aluminum or steel aerosol can is an exemplary container. However, the container may be comprised of various materials or combinations of materials as described above. The container may also include coatings which can be formed on the inside or outside of the can.

To reiterate, a dispense system may comprise a container, a collar, and a cap. The components are adapted, as described in more detail below, to lock together such that rotation of the cap or the collar will cause the entire cap assembly to rotate about the container and the cap will not detach. Only upon manipulating or displacing the cap relative to the collar can the cap be unlocked from the collar allowing access to a spray actuator.

Examples of cap assemblies are provided hereinafter. However, it is to be understood that certain features described hereinafter may be replaced by other features as is known by those of ordinary skill in the art. The following is provided only for exemplary purposes and is not intended to limit the invention. The invention is intended to be limited only by the limitations set forth in the appended claims.

Latch Lock Cap Assembly

Figure 2A:
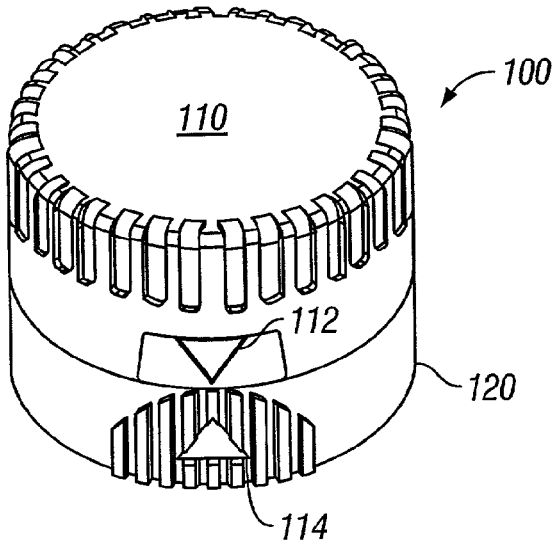
FIG. 2A is a front perspective view of a cap assembly.

FIG. 2A depicts a cap assembly (100) and includes a cap (110) detachably affixed to a collar (120). As described above the collar can be secured to a lip of a container (not shown).

To lock the cap (110) onto the collar (120), the cap is positioned on the collar and rotated or twisted until indicia (112, 114) are aligned. In particular, the cap is rotated clockwise until a first arrow (112) on the cap is aligned with a second arrow (114) on the collar (120). Once the arrows are aligned, slots or latches described below lock the cap to the collar.

Figure 2B:
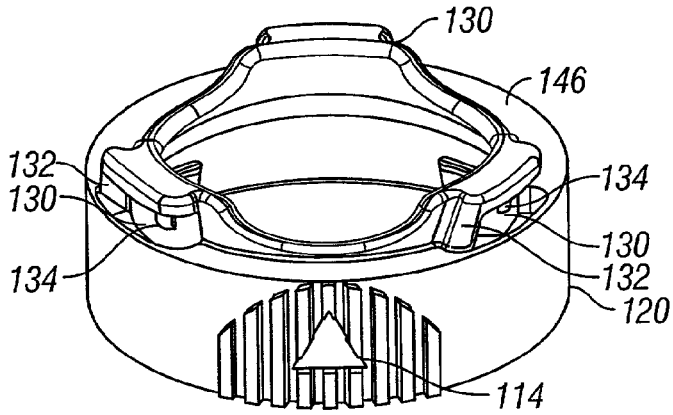
FIG. 2B is a top perspective view of the collar shown in FIG. 2A.
Figure 2C:
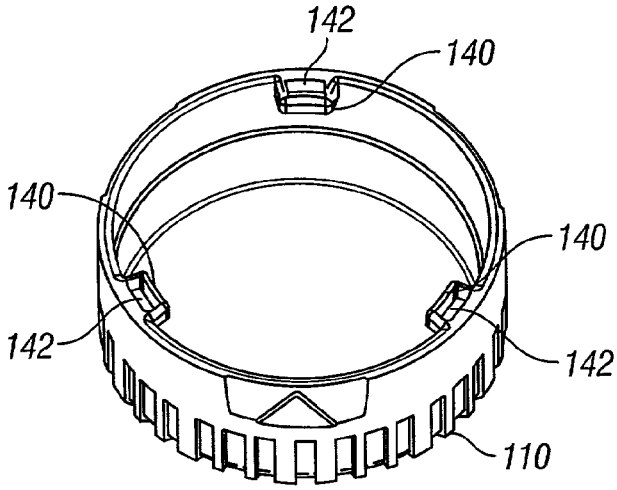
FIG. 2C is a bottom perspective view of the cap shown in FIG. 2A.

Referring to FIG. 2B, the collar (120) includes a number of peripheral slots (130) which are adapted to receive teeth (140) of the cap. A bottom perspective view of the cap is shown in FIG. 2C. The collar also includes a ridge or rim (146) that provides a platform for the teeth (140) to contact when the cap is positioned on the collar.

Again, to lock the cap (110) to the collar (120), the cap is positioned on the collar and is rotated clockwise while holding the collar. The teeth follow the rim (146) into the corresponding slots (130). The slots (130) are shown having stops (132) which prevent further rotation of the cap in the clockwise direction. The slots (130) also may include protrusions (134), which lock the teeth (140) into place after a tooth passes across the protrusion (134). Each tooth is thus locked between a stop (132) and a protrusion (134) when the cap is sufficiently rotated clockwise relative to the collar. The protrusions (134), however, need not be large and are configured such that the cap may be disengaged from the slots upon firmly holding the collar while rotating the cap counterclockwise.

To unlock the cap assembly (100), the collar (120) is firmly held and the cap (110) is rotated counterclockwise until the teeth are no longer contained in the slots (130). Typically, an adult may feel that the teeth are unlocked and the cap may be removed. Also, as shown in FIGS. 2A–2C, indicia (112, 114) may be included to indicate the relative positions of the teeth relative to the slots.

It is to be understood that the number of teeth and slots may vary. While 3 slots/teeth are shown in this cap assembly, 2 to 10 slots/teeth may be provided or perhaps more than 10 slots/teeth may be provided. Also, the shapes and styles of the slots and teeth may vary. The teeth may be square, sharp, curved, straight, elongated, short, etc. Also, as shown in FIG. 2C, the teeth can include an opening or space (142). The teeth may also be solid or otherwise filled. The cap and collar may thus have various types of primary and complementary features to provide the locking in accordance with the present invention.

Additionally, the components of the cap assembly (100) may include grips, grooves and other textures for convenient handling and structural reinforcement.

Figure 2D:
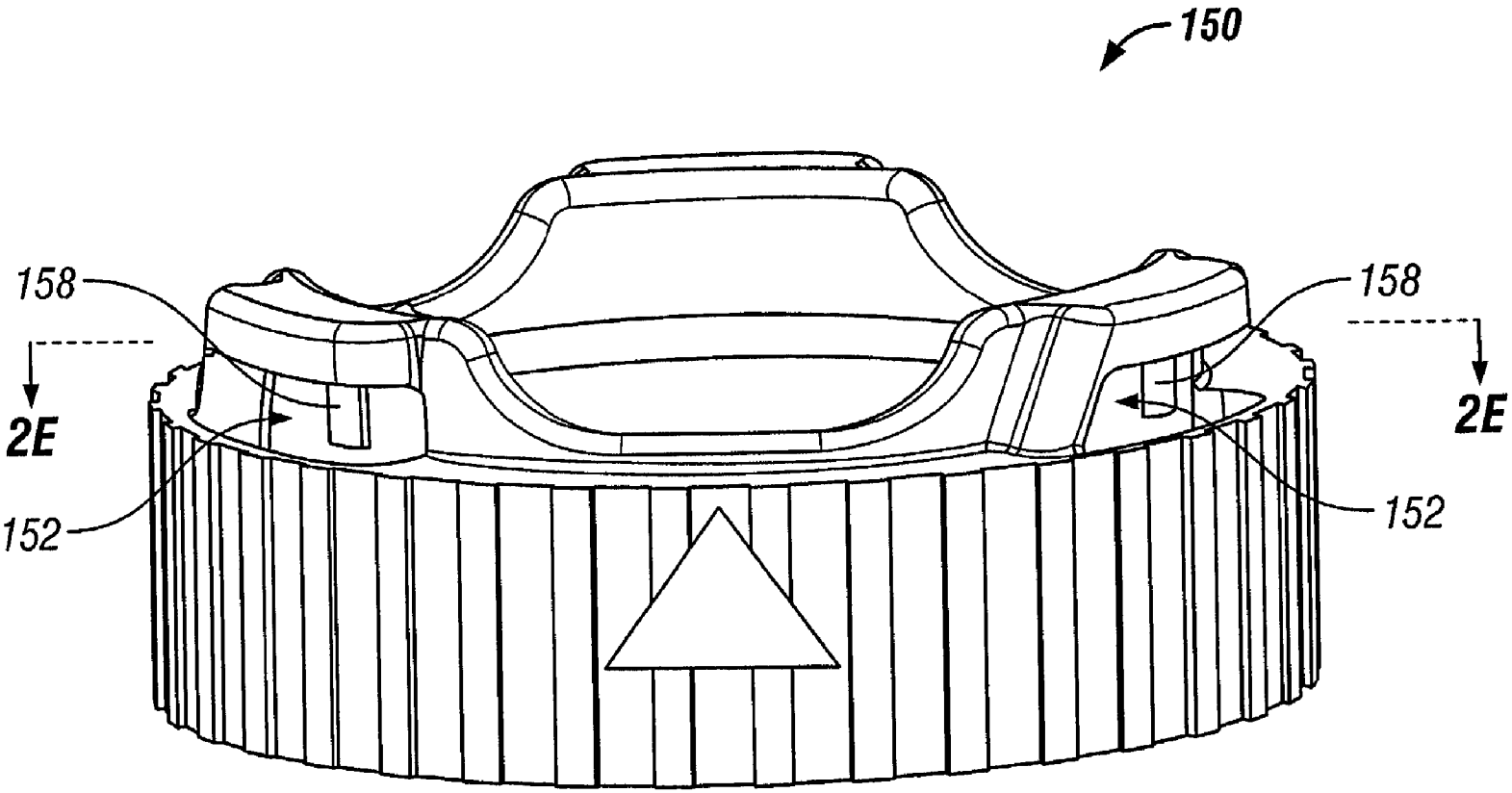
FIG. 2D is a perspective view of a collar.
Figure 2E:
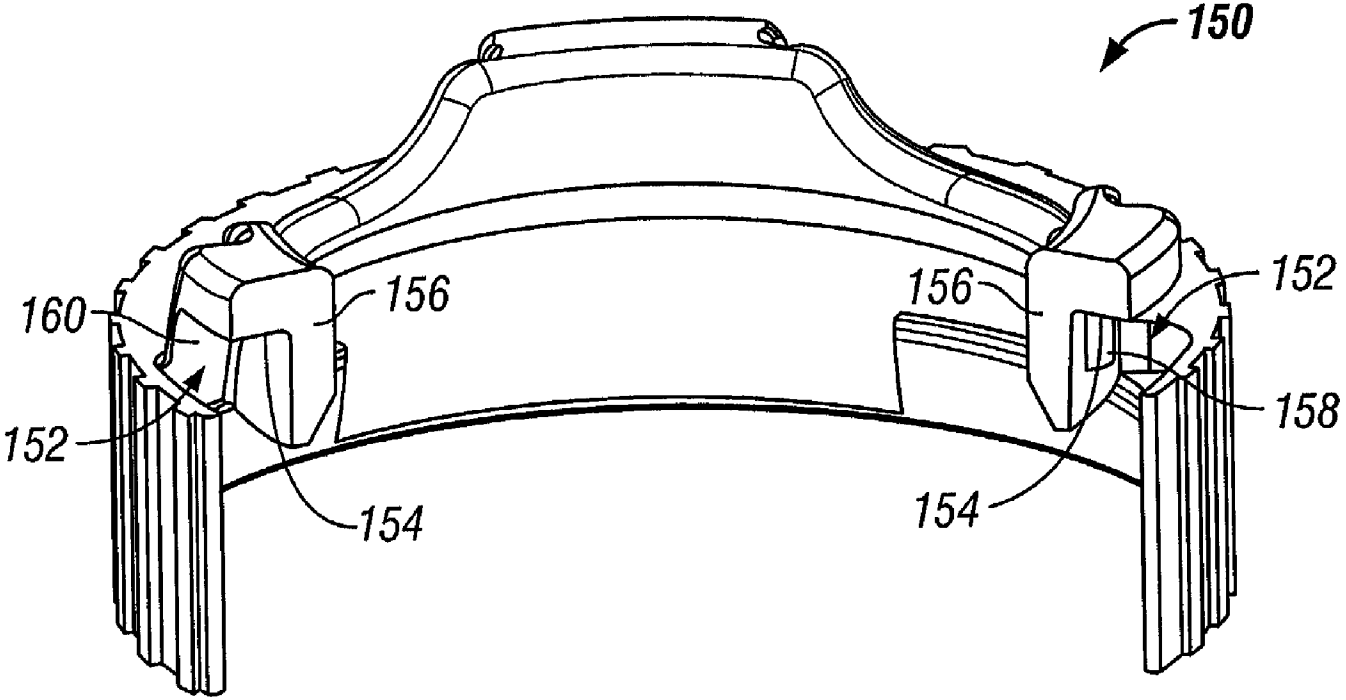
FIG. 2E is a cross sectional view of the collar shown in FIG. 2D taken along line 2E—2E.
Figure 2G:
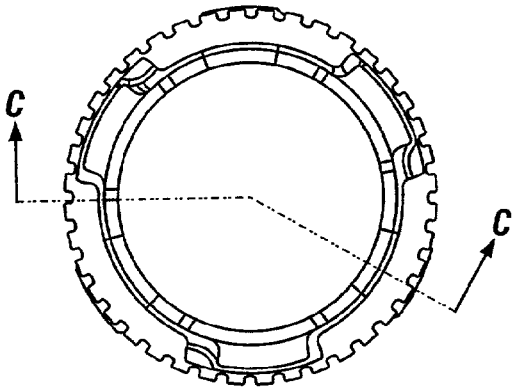
FIGS. 2F–2H are front, top, and bottom views respectively of a collar having three slots.
Figure 2I:
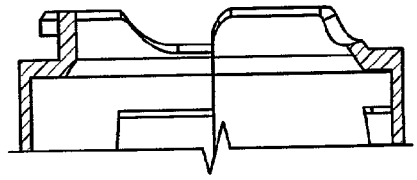
FIG. 2I is a cross sectional view of the collar shown in FIG. 2G taken along line C—C.
Figure 2F:
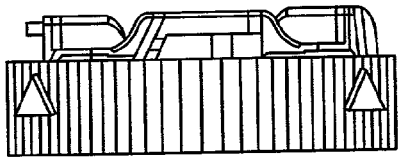
Figure 2H:
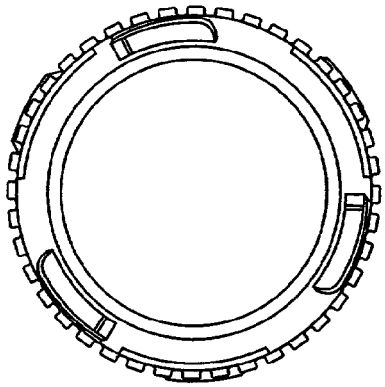

FIG. 2D shows another perspective view of a collar (150) having slots (152). FIG. 2E is a cross sectional view of the collar shown in FIG. 2D. As shown in these figures, the slots (152) may comprise an upper wall (154), a side wall (156), a protrusion (158) and a rear wall or stop (160). The slots receive teeth (not shown) of the cap to lock the cap to the collar.

FIGS. 2F–2I illustrate standard views of a collar and are provided to further illustrate details of an exemplary collar.

Figure 2J:
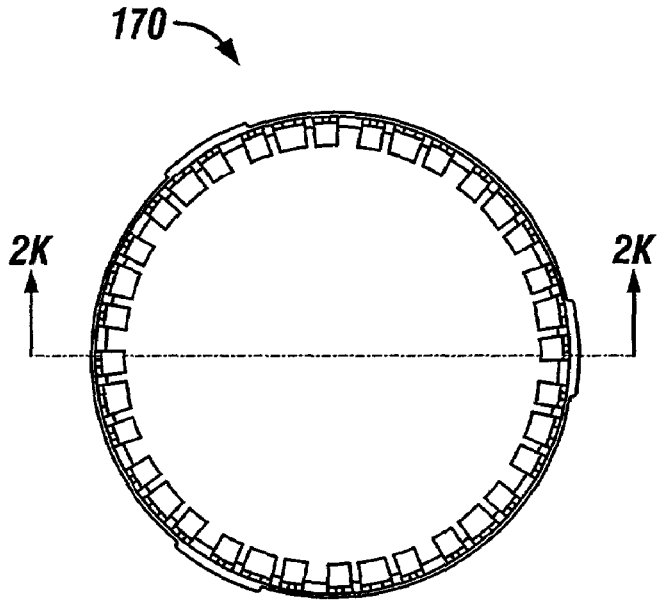
FIG. 2J is a top view of an aerosol system having a can, a cap and a collar having slots.
Figure 2K:
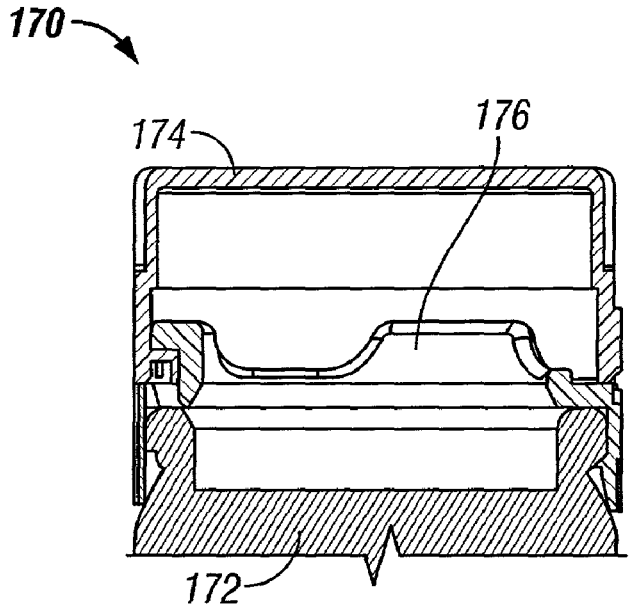
FIG. 2K is a cross sectional view of the aerosol system shown in FIG. 2J taken along line 2K—2K.

FIG. 2J shows a top view of an assembled aerosol system. FIG. 2K shows a partial cross sectional view of the system. The system (170) includes a container (172), a cap (174), and a collar (176) having slots for receiving teeth of the cap to lock the cap to container. The cap interlocks with the collar and container as described above. The cap and collar may rotate about the container when turned or twisted unless the cap and collar are moved relative to one another.

Snap Lock Cap Assembly

Figure 3B:
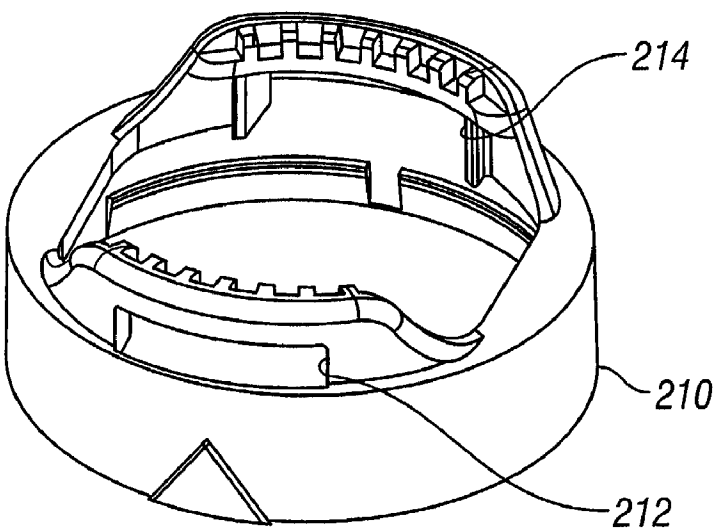
FIG. 3B is a top perspective view of the collar shown in FIG. 3A.
Figure 3A:
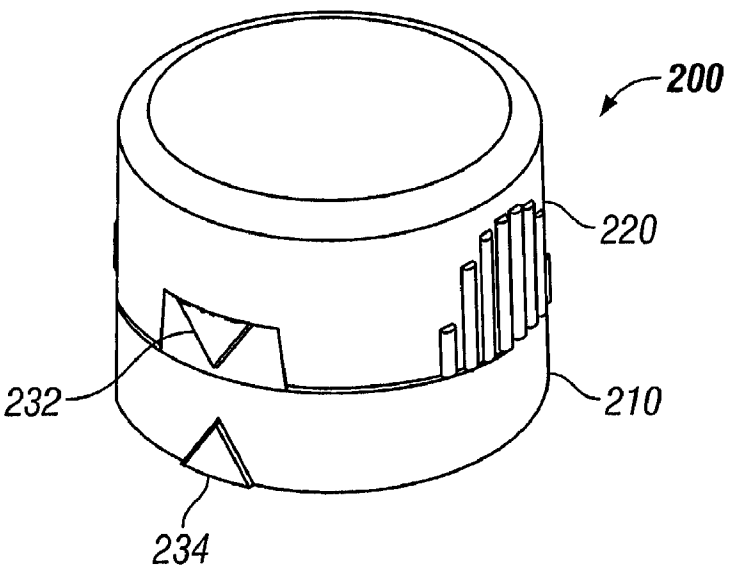
FIG. 3A is a front perspective view of another cap assembly.
Figure 3D:
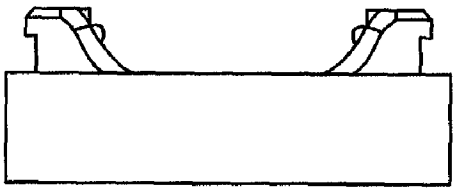
FIGS. 3D–3G are front, top, bottom, and side views respectively of a collar having openings.
Figure 3E:
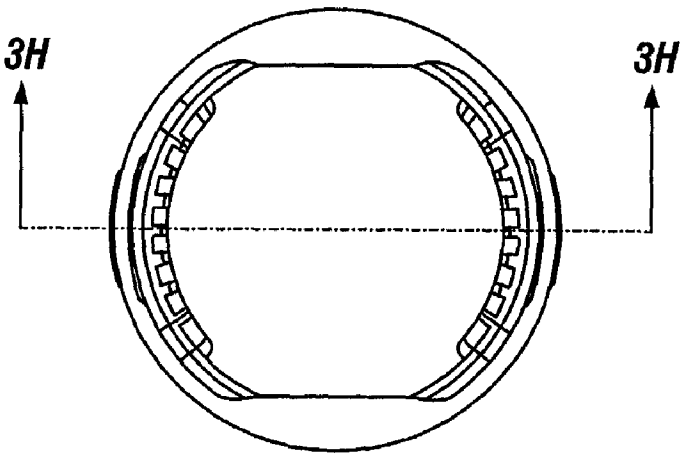

FIG. 3A depicts another cap assembly (200). The cap assembly (200) includes a collar (210) and a cap (220). As described above the collar may be secured to an upper lip or flange of a container (not shown). The collar (210) includes openings (212, 214) which are adapted to receive teeth (222, 224) respectively. FIG. 2C shows a bottom perspective view of the cap (220).

Figure 3C:
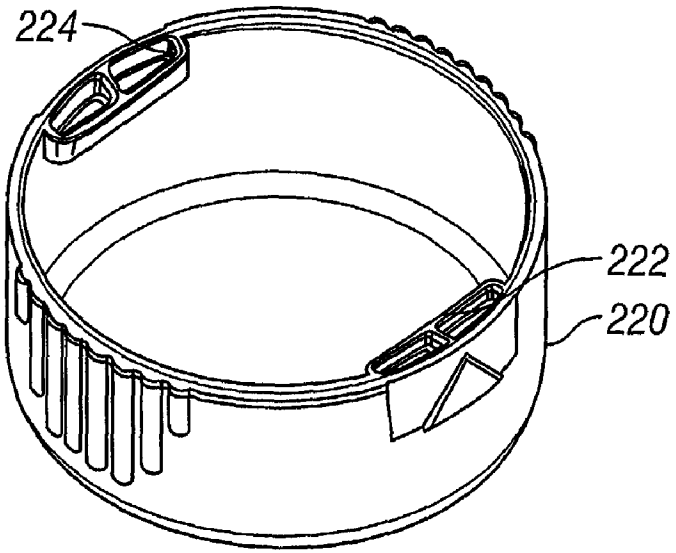
FIG. 3C is a bottom perspective view of the cap shown in FIG. 3A.
Figure 3F:
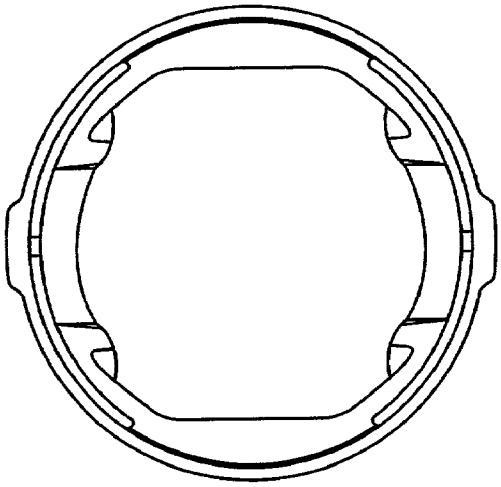
Figure 3G:
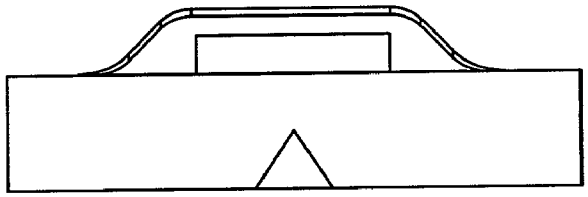
Figure 3H:
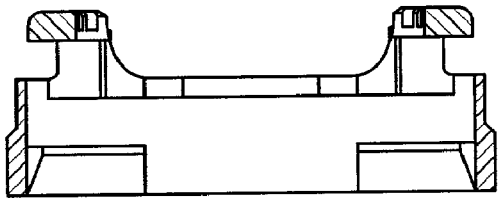
FIG. 3H is a cross sectional view of the collar shown in FIG. 3E taken along line A—A.

To lock the cap (220) upon the collar (210), the large tooth (224) is engaged with large opening (214) of the collar. While the cap is positioned at an angle (for example, 10–50 degrees or perhaps about 10–20 degrees), the cap is squeezed and pressed down until the small tooth (222) is engaged with the small opening (212). Also, indicia (232, 234) may be provided to facilitate alignment of the teeth with the opening. In the cap assembly shown in FIGS. 3A–3C, arrows (232, 234) are provided to indicate when the teeth are aligned with the openings.

To unlock the cap (220) from the collar (210), the cap is squeezed until one of the small tooth or the large tooth is disengaged from a corresponding opening in the collar. Once one tooth is disengaged, the cap is lifted thereby detaching the cap from the container.

It is to be understood that the teeth and openings may be variously shaped and still be in accordance with the present invention. The teeth may be identical or different for example. Also, there may be more than two teeth/opening combinations.

FIGS. 3D–3H illustrate standard views of a collar having openings and are provided to further illustrate details of an exemplary collar having openings.

Figure 4A:
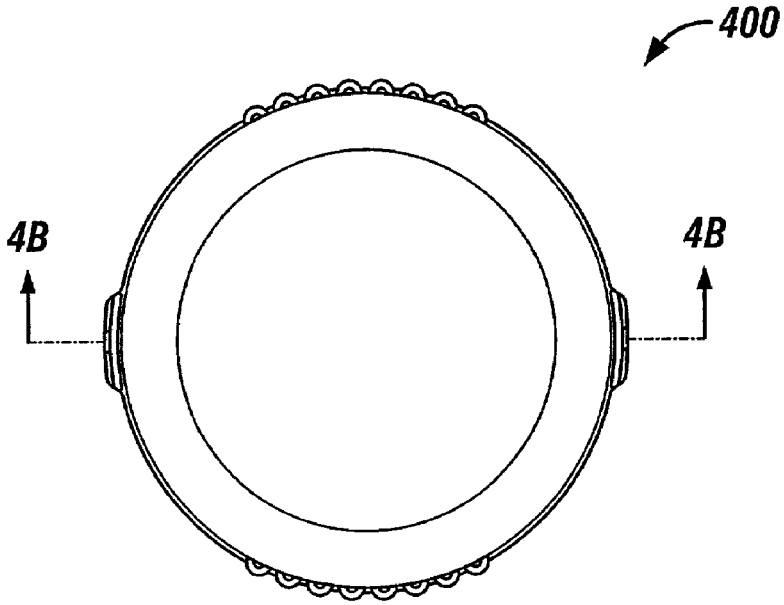
FIG. 4A is a top view of an aerosol system having a can, a cap and a collar having openings.
Figure 4B:
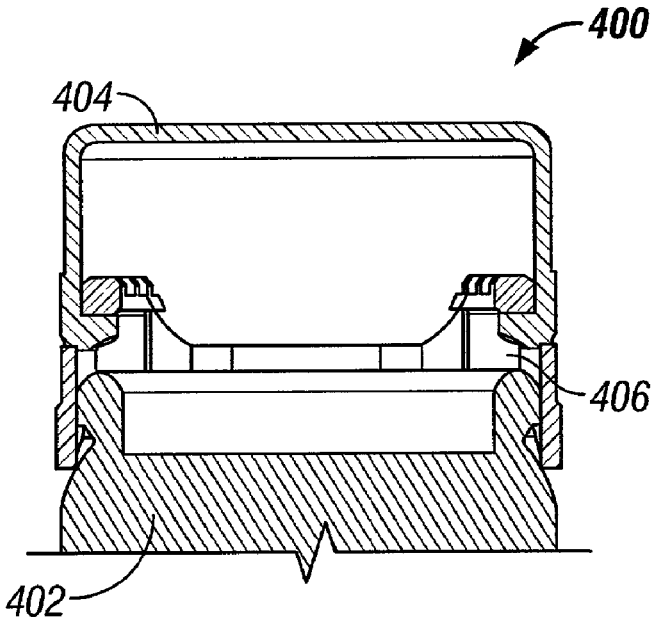
FIG. 4B is a cross sectional view of the aerosol system shown in FIG. 4A taken along line 4B—4B.

FIG. 4A shows a top view of an assembled aerosol system (400) in accordance with the present invention. A partial cross section is shown in FIG. 4B and includes a container (402), a cap (404), and a collar (406) having an opening for receiving teeth of the cap to lock the cap to the container. The cap interlocks with the collar and container as described above. Again, the cap and collar rotate about the container as a whole when turned or twisted.

Figure 5A:
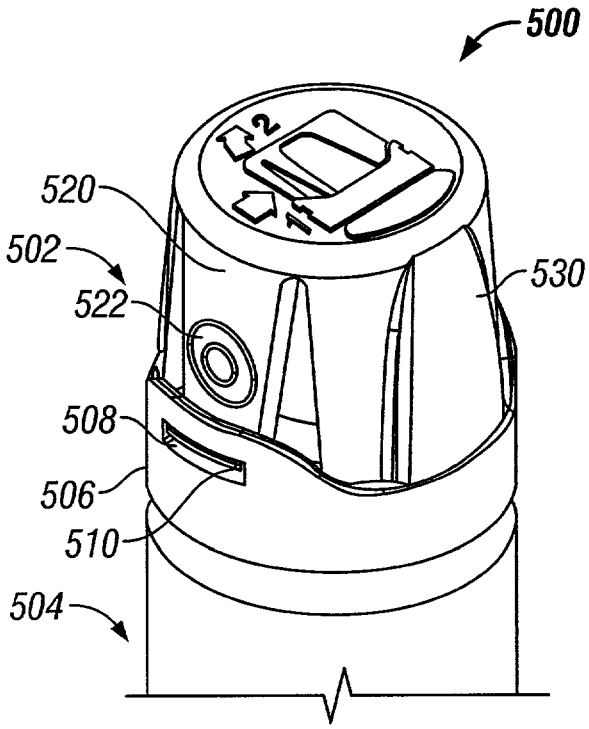
FIG. 5A is a partial perspective view of an another dispense system having a can, a collar, and a cap having a deflectable tab.

FIGS. 5A–6B depict another cap assembly (500) for enclosing a spout (501) of a can (504). Referring to FIG. 5A, the cap assembly (500) includes a collar (506) and a cap (502) removably mounted to the collar. As described above, the collar (506) has a lower portion which is adapted to mount to the upper rim of the can (504). The collar may be rotatable or not rotatable about the can. When the collar is rotatable and the cap is mounted to the collar, the cap and collar may spin or rotate when twisted without detaching from the can. In this manner, the cap assembly serves to prevent unsophisticated individuals such as, perhaps, children from accessing the actuator (501).

The collar (506) may include at least one opening (508) which is configured to receive a tooth (510) of the cap. In the cap assembly depicted in FIGS. 5A–6B, the tooth extends outwardly from a deflectable tab (520) of the cap. The deflectable tab (520) is movably coupled to the cap such that the outwardly extending tooth may be manipulated into opening (508) to secure the cap to the collar. In one construct, the cap is formed of a plastic which is sufficiently resilient or flexible so as to bias the tab (520) in locking alignment as shown in these figures. Thus, when at rest, the tab shown in this figure tends to project outwardly. When the tooth is aligned with the opening in the collar, the tooth penetrates the opening locking the cap to the collar.

To unlock the cap from the collar, the tab (520) is depressed and the cap is twisted while holding the collar until the teeth are disengaged from the openings. To aid in deflecting the tab, a grip feature (522) may be disposed on the deflectable tab. Depressing the grip (522) to a certain degree releases the tooth (510) from the opening (508), unlocking the cap. Once the cap is unlocked, the cap may be removed from the collar and can.

Figure 5B:
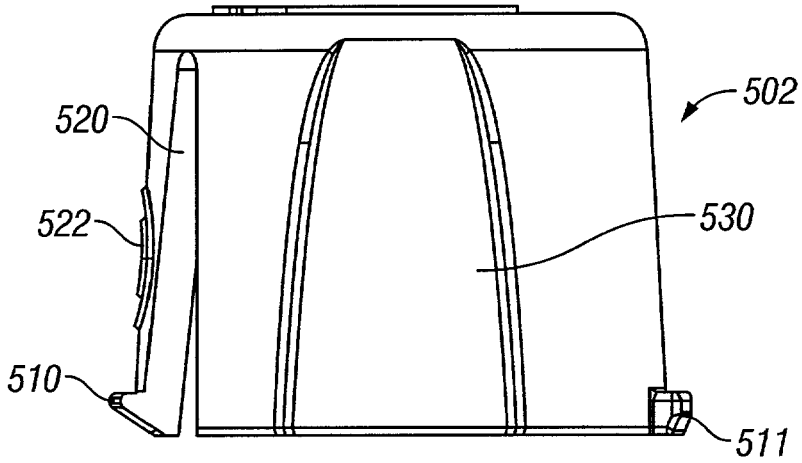
FIG. 5B is a side view of a cap having a deflectable tab.
Figure 6A:
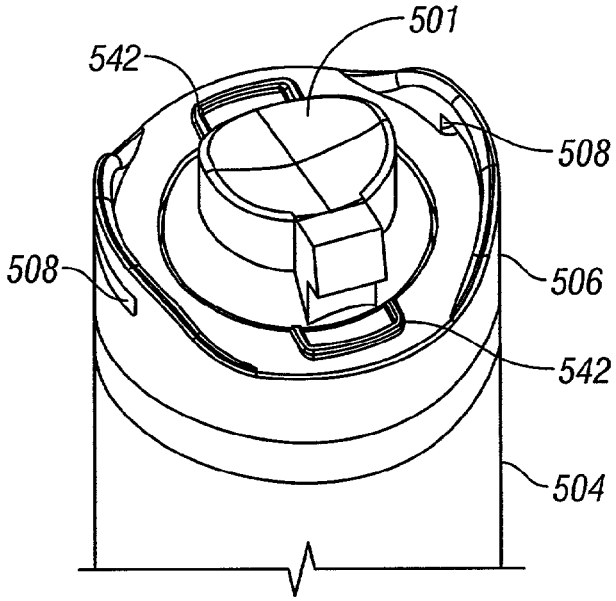
FIG. 6A is a partial perspective view of an aerosol system with a cap removed and includes an aerosol can, a spout, and a collar mounted on the can.
Figure 6B:
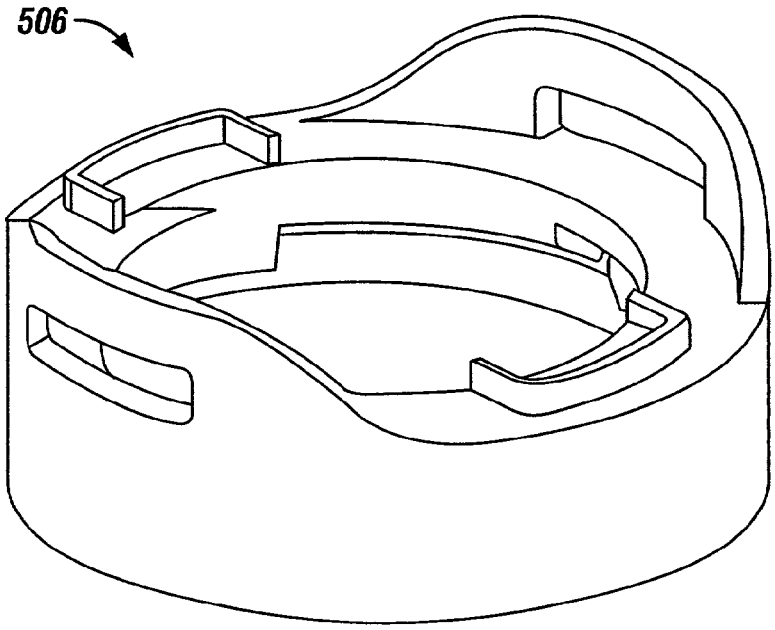
FIG. 6B is a perspective view of another collar having openings for receiving teeth which may be used in a dispensing system.

The cap (502) may include additional teeth (511) each of which is receivable in a corresponding opening in the collar (506). The number of teeth may vary widely and in some constructs may range from 1–10, perhaps 2–3 or 1–2. All or a portion of such teeth may extend from a deflected tab. Additionally, the cap assembly may be designed such that the at least one tooth extends radially inwardly into an opening in the collar instead of outwardly as shown in FIGS. 5A and 5B.

The cap assembly shown in FIGS. 5A–6B also includes aligning components. In particular, the collar (506) includes guides (542) which, when the cap is properly positioned on the collar, serve to align the cap on the collar. Ears (530) on the cap fit around the guides.

To reiterate, the cap assemblies described herein serve to make an aerosol container more child resistant and senior friendly. As described above, a collar may be mounted to the mounting lip or rim of a container. The collar, in some variations, may rotate freely about the mounting lip of the container but is not substantially moveable in the axial direction.

Next, a cap is manipulated onto the collar until its teeth engage openings or slots of the collar. For example, in one variation, the cap is positioned on a collar and rotated clockwise until its teeth snap into corresponding latches of the collar.

Once the teeth of the cap are engaged with the corresponding openings or slots of the collar, the cap assembly is properly locked. The locked cap assembly serves to hinder, for example, a child from unlocking the cap assembly because when the individual rotates the cap, the whole cap assembly rotates about the mounting lip of the container. Mere turning of the cap will not disengage the cap from the collar. Only by unlocking the cap as described above will the cap disengage from the collar providing access to the spray button therein.

One-piece Cap Assembly

Figure 7B:
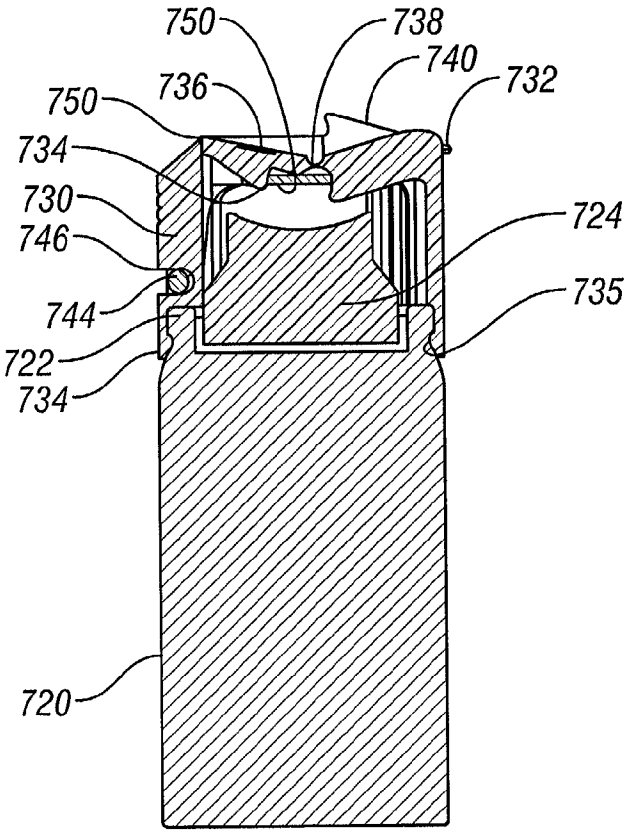
FIG. 7B is a cross sectional view of the dispensing system shown in FIG. 7A taken along 7B—7B.
Figure 7A:
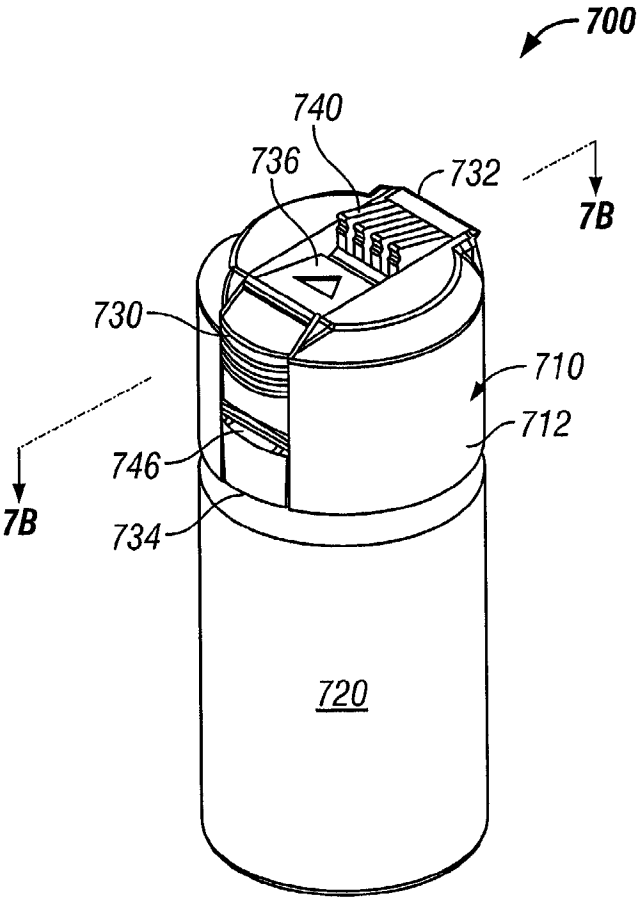
FIG. 7A is another dispensing system having a cap which is lockable with a container.

FIGS. 7A–7B depict another dispense system (700) including a cap (710) which is releasably lockable to a container (720). The dispensing system shown in these figures does not include a collar or proxy member. Rather, the cap (710) may mount directly to the container and in particular, directly to the upper rim (722) of the container (720). The cap (710) serves to enclose an actuator (e.g., a spout 724) disposed on the top of a container preventing access to the actuator (724).

As shown in FIGS. 7A–7B, the cap may include a cylindrical body (712) having a lower portion which is adapted to mount to an upper rim (722) of the can. The cap (710) also includes a movable or pivotal member (730) which pivots or moves relative to the body of the cap. The movable member (730) is shown having a fixed end (732) coupled to the body and a free end (734). The free end includes a lip or similar feature which projects inwardly from the free end. That is, as shown in FIG. 7B, the lip (734) extends inwards towards the center of the can's mounting cup. The free end and lip are constructed to fit and engage the upper rim (722) of the can. These shapes may be as shown in FIGS. 7A–7B or they may be otherwise shaped as long as a portion of the movable member engages, snaps or otherwise locks with the rim (722).

The movable member (730) of cap (710) may also include additional features as shown in FIGS. 7A–7B including a tooth (734) which, when button (736) is depressed, penetrates or engages a slot (738) to lock the moving member in a locked position as shown in FIG. 7B. Locking the movable member tends to prevent the cap from being manually deformable making it more difficult to remove the cap from the can.

When it is desired to remove the cap from the can, the cap may be unlocked by urging a release member (740) rearwards. This forces tooth (734) from slot (738) and causes a distal section of the movable member to pivot about an axle (744) such that the free end of the movable member disengages from the upper rim. Also, the distal section of the movable member may include a channel (746) which is shaped to receive the axle (744).

When the movable member (730) is not in its locked position the cap may be removed from the can. In particular, when the movable member is not in its locked position, the cap may be squeezed or deformed to some extent such that the circumferential lip (735) of cap (710) may be disengaged from the upper rim (722) of the can. In this manner, the movable member (730) acts as a locking-member means which locks and unlocks the cap to the can. Such a locking means serves to prevent unsophisticated individuals such as, perhaps, children from dispensing the contents of the can.

It is to be understood that the above described pivotal (or movable) member may have various constructs and still be in accordance with the present invention. The movable member may include more or less joints for example than that shown in FIGS. 7A–7B. Additionally, the movable member may conform or not conform to the shape of the cap. The movable member may be off-center or on-center and the cap may be symmetrical or unsymmetrical about the movable member.

The cap may be fabricated from plastic or other materials. It may be one integral piece such as an injection molded plastic part. Also, the cap may comprise various individual components fastened together using fasteners such as pins or other fastening techniques. Since the part may be plastic, plastic joining and fastening techniques may be utilized.

Figure 8:
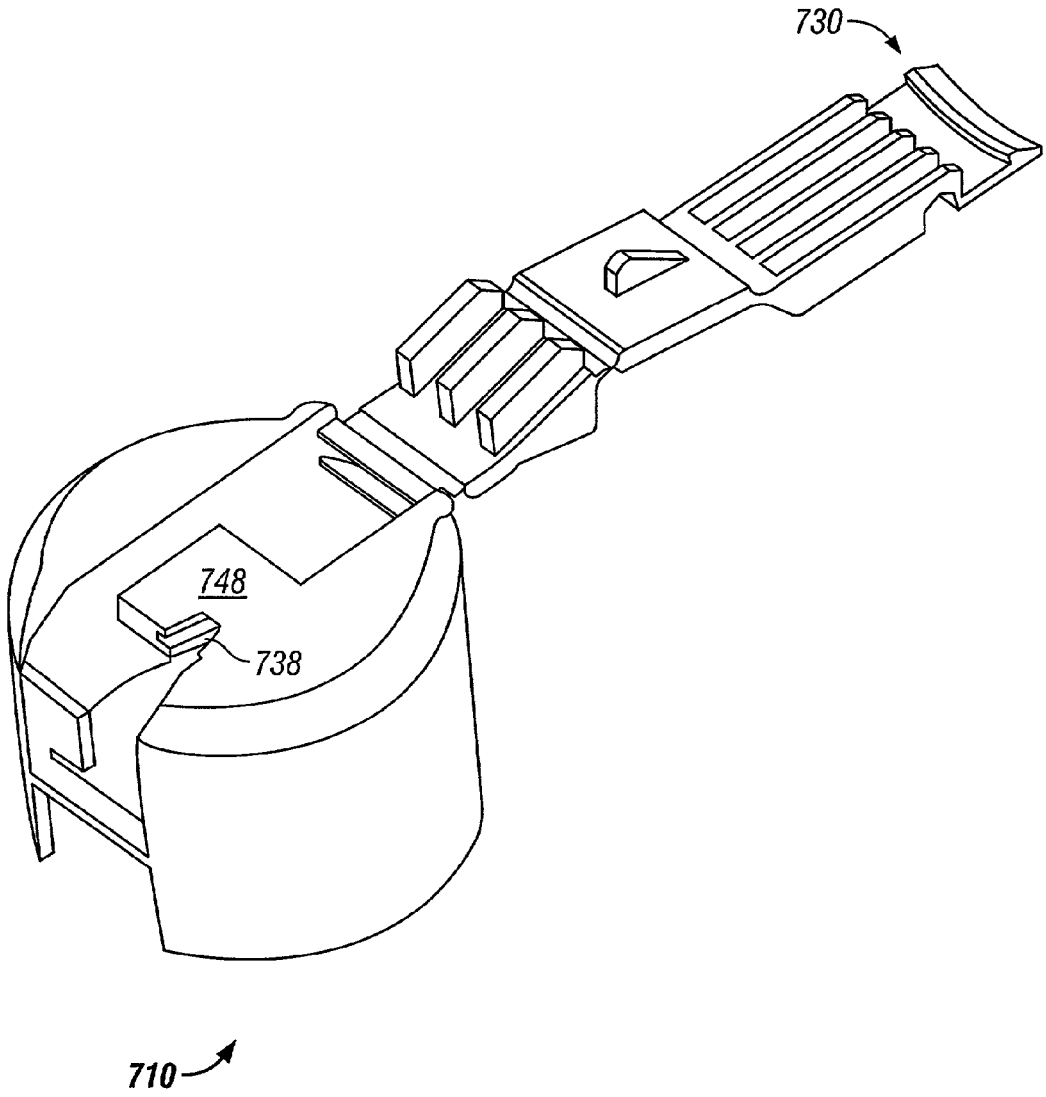
FIG. 8 shows the cap of FIG. 7A in an unassembled configuration.

FIG. 8 shows a perspective view of a cap (710) detached from a can and in an unassembled configuration. The cap (710) includes a strut (748) connected to the body of the cap. The strut may have a receiving portion adapted to releasably receive the tooth of the pivotal member (730). The receiving portion of the strut may be, e.g., an opening, a groove, or a slot. In one configuration, the receiving portion is a slot. The slot may also be smoothly curved, square or otherwise shaped. It may be, for example, hemispherical.

Figure 9A:
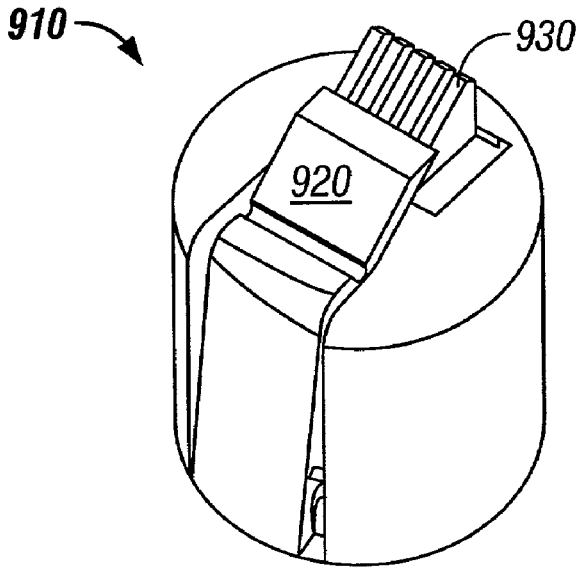
FIG. 9A shows another cap which is directly lockable to a container.
Figure 9B:
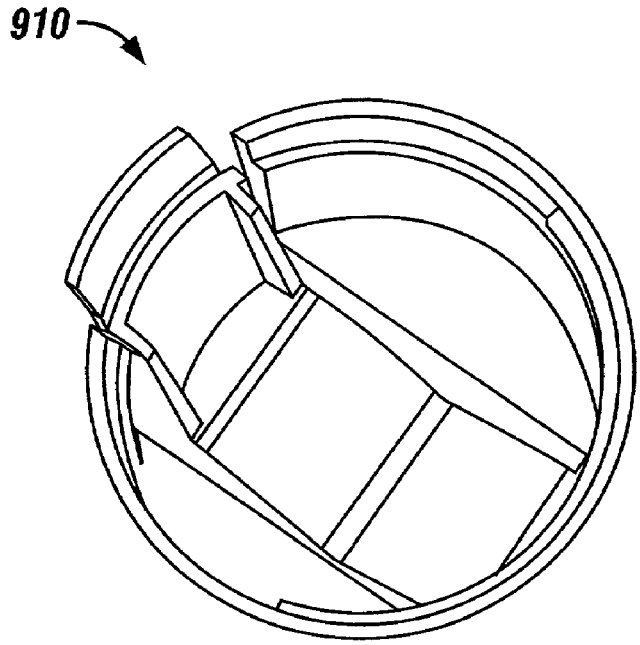
FIG. 9B shows a bottom perspective view of the cap shown in FIG. 9A.

FIGS. 9A–9B depict a cap (910) having a movable member that does not include a channel for receiving an axle. The movable member, however, is configured to engage the upper rim of a can (not shown). In particular, the movable member is configured to lock to an upper rim of a can when button (920) is depressed. Also, when release region (930) is urged rearwards, the movable member disengages from the upper rim of a can.

The cap assemblies described herein may also be used to retrofit an aerosol can having a conventional cap. The conventional cap is replaced with the cap assembly of the present invention. The cap assembly of the present invention thus may be provided as a separate kit or in combination with a container.

A dispense system may also include a container, a collar securely affixed to the container, and a cap removably locked to the collar. Unlike the above disclosed cap assemblies, however, the collar in this variation is mounted fixedly to an upper lip of the container such that it cannot rotate or detach from the container. In this manner, the collar is a "proxy" for connecting the cap to the container. When using containers having undesirable flanges, damaged rims or lips which are otherwise difficult to cover with a cap, a proxy device such as the collar of the present invention may be employed. The proxy device or collar is secured to the lip as discussed above and provides a convenient structure for mounting a safety cap thereto.

All publications, patent applications, patents, and other references mentioned in this application are incorporated by reference in their entirety. To the extent there is a conflict in a meaning of a term, or otherwise, the present application will control.

The above described systems, assemblies, methods, and examples are illustrative only and not intended to limit the invention which is intended to be limited only by the limitations set forth in the appended claims. Additionally, other features and advantages of the invention will be apparent to those of ordinary skill in the art and such changes and modification may be made without departing from the spirit and scope of the invention as set forth in the appended claims.

The invention claimed is:

1. A dispensing system comprising:

a container having a cylindrical body with an upper rim contiguous with said cylindrical body and an actuator for selectively dispensing contents of said container;

a collar rotatably attached to said upper rim of said container; and a cap detachably locked in said collar and enclosing said actuator, said cap having at least one primary feature adapted to interlock with a complementary feature on said collar without the cap engaging the container such that when said primary feature is interlocked with said complementary feature said cap is locked to said collar and when said cap is rotated said cap and collar rotate together without detaching from said container.

2. The dispensing system of claim 1 wherein said at least one primary feature of said cap is a tooth and said complementary feature on said collar is an opening adapted to receive said tooth.

3. The dispensing system of claim 2 wherein said cap comprises at least two teeth and said collar comprises at least two openings adapted to receive said at least two teeth.

4. The dispensing system of claim 3 wherein said at least two teeth are different.

5. The dispensing system of claim 3 wherein said at least two teeth are identical.

6. The dispensing of claim system 3 wherein said two teeth are opposite of one another and wherein said cap is deformable such that said cap may be squeezed in order to insert said teeth into said openings.

7. The dispensing claim 1 wherein said at least one primary feature is a tooth and said at least one complementary feature is a slot.

8. The dispensing system of claim 7 wherein said slot includes a stop such that when said cap is positioned on said collar and said cap is rotated relative to said collar into a locked position, said cap is prevented from further relative rotation by said stop.

9. The dispensing system of claim 8 wherein said collar further includes a ridge which provides a surface for said tooth of said cap to follow into said slots.

10. The dispensing system of claim 9 wherein said slot further includes a protrusion to secure said tooth into said slot after said tooth passes across said protrusion.

11. The dispensing system of claim 1 wherein said upper rim projects inward.

12. The dispensing system of claim 1 wherein said upper rim projects outward.

13. The dispensing system of claim 1 wherein the container further comprises an inner coating.

14. The dispensing system of claim 13 wherein said inner coating is a substance selected from the group consisting of epoxy and Palyamid-imid.

15. The dispensing system of claim 1 wherein the container is made of glass and comprises an exterior coating.

16. The dispensing system of claim 1 wherein said actuator comprises a dispense spout.

17. The dispensing system of claim 1 wherein said actuator is a push button.

18. The dispensing system of claim 1 wherein said container is an aerosol can and said contents are pressurized.

19. File dispensing system of claim 1 wherein said actuator is a pump and said contents are unpressurized.

20. The dispensing system of claim 18 further comprising a non-foamable substance held within said container.

21. The dispensing system of claim 20 wherein said non-foamable substance is an aerosol spray.

22. The dispensing system of claim 18 further comprising a foamable substance held within said container.

23. The dispensing system of claim 2 wherein said tooth projects inwardly.

24. The dispensing system of claim 2 wherein said tooth projects outwardly.

25. The dispensing system of claim 24 wherein said tooth extends from a deflectable tab attached to said cap.

26. The dispensing system of claim 25 wherein said cap comprises at least one additional tooth which is receivable by an additional opening in said collar.

27. The dispensing system of claim 1 further comprising a nozzle attached to said actuator.

28. A cap assembly for enclosing an actuator of a dispensing container, said cap assembly comprising:

a collar configured to rotatably attach to a mounting lip of said container, wherein said mounting lip is substantially contiguous with an outer cylindrical body of the container, and wherein when attached, the collar is an extension of the outer body of the container; and a cap detachably affixed to said collar and enclosing said actuator when said assembly is mounted on said container, said cap having at least one primary feature configured to engage a complementary feature on said collar without the cap engaging the container such that when said primary feature is engaged with said complementary feature said cap is locked to said collar and when said cap is locked to said collar said cap assembly rotates as a whole about said container when one of said cap and collar is rotated.

29. The cap assembly of claim 28 wherein said primary feature of said cap is a tooth.

30. The cap assembly of claim 29 wherein said complementary feature of said collar is a slot configured to interlock with said tooth when said cap is rotated relative to said collar.

31. The cap assembly of claim 29 wherein said complementary feature of said collar is an opening configured to receive said tooth.

32. The cap assembly of claim 31 wherein said tooth projects inwardly.

33. The cap assembly of claim 31 wherein said tooth projects outwardly.

34. The cap assembly of claim 33 wherein said tooth extends from a deflectable tab which has a fixed end attached to said cap.

35. The cap assembly of claim 34 wherein said cap comprises an additional tooth which is receivable by an additional opening in said collar.

36. The cup assembly of claim 28 comprising a plurality of primary features and a plurality of complementary features to engage with said primary features.

37. A dispensing system comprising:

a container having an outer cylindrical body with an upper mounting lip substantially contiguous with said outer cylindrical body and an actuator for selectively dispensing contents of said container;

a collar rotatably secured to said upper mounting lip; and a cap removably attached to said collar and enclosing said actuator, said cap having a locking means for releasably locking with said collar without the cap engaging the container wherein said cap and collar rotate together when one of said cap or collar is rotated.

38. A method of retrofitting a container having a cylindrical outer body and an actuator comprising:

mounting a rotatable collar to a lip on the cylindrical outer body of said container such that said collar may rotate about said container when twisted, wherein the collar is an extension of the outer body; and detachably affixing a cap onto said collar enclosing said actuator without the cap engaging the container, said cap being detachably affixed to said collar such that when said cap is rotated said cap and collar rotate as a whole about said container without detaching from said container thereby preventing access to said actuator.

39. The method of retrofitting a container as recited in claim 38 further comprising removing a conventional cap from said container prior to rotatably mounting said collar to said container.

40. The method of retrofitting a container as recited in claim 38 wherein said detachably affixing a cap onto said collar includes rotating said cap relative to said collar.

41. The method of retrofitting a container as recited in claim 38 wherein said detachably affixing a cap onto said collar includes squeezing said cap to position at least one tooth of said cap into an opening in said collar.

42. The method of retrofitting a container as recited in claim 38 wherein said container is an aerosol can.

43. A dispensing system comprising:

a container having an outer cylindrical body with an upper mounting lip substantially contiguous with said outer cylindrical body and an actuator for selectively dispensing contents of said container;

a collar rotatably secured to said upper mounting lip; and a cap removably attached to said collar and enclosing said actuator wherein said cap is adapted to lock with said collar without the cap engaging the container and wherein said cap and collar rotate together when one of said cap or collar is rotated.

44. A cap assembly for enclosing an actuator of a dispensing container, said cap assembly comprising:

a collar configured to rotatably attach to a mounting lip of said container; and a cap detachably affixed to said collar and enclosing said actuator when said assembly is mounted on said container, said cap having at least one primary feature configured to engage a complementary feature on said collar without the cap engaging the container such that when said primary feature is engaged with said complementary feature said cap is locked to said collar and when said cap is locked to said collar said cap assembly rotates as a whole about said container when one of said cap or collar is rotated.

* * * * *